United States Patent [19]

Neveu

[11] Patent Number: 4,645,699

[45] Date of Patent: Feb. 24, 1987

[54] PILE CLEANING MATERIAL AND NEEDLING METHOD OF MAKING SAME

[75] Inventor: Jean-Louis Neveu, Beauvais, France

[73] Assignee: Spontex Incorporated, Columbia, Tenn.

[21] Appl. No.: 748,017

[22] Filed: Jun. 24, 1985

[30] Foreign Application Priority Data

Jun. 27, 1984 [GB] United Kingdom ..... 8416344
Nov. 5, 1984 [EP] European Pat. Off. ..... 84402208.7

[51] Int. Cl.[4] ..... B32B 3/02

[52] U.S. Cl. ..... 428/95; 428/300; 26/2 R; 26/18.5; 28/107

[58] Field of Search ..... 428/95, 300; 28/107; 26/2 R, 18.5

[56] References Cited

U.S. PATENT DOCUMENTS 4,355,067 10/1982 Neveu ..... 428/300

FOREIGN PATENT DOCUMENTS 1102361 9/1965 United Kingdom .
1154842 7/1966 United Kingdom .
1229781 12/1966 United Kingdom .
1355180 11/1970 United Kingdom .
1501871 2/1974 United Kingdom .
1517375 7/1975 United Kingdom .

*Primary Examiner*—Marion C. McCamish
*Attorney, Agent, or Firm*—Roberts, Spiecens & Cohen

[57] ABSTRACT

A cleaning material constituted of a non-woven web of fibers having ends and/or loops protruding from one face thereof, and obtained by needle-punching a web containing a mixture of at least two fibers, one of which has a weight of at least 100 decitex and the other a weight equal to or less than 30 decitex. The cleaning material may be bonded to a porous body, for example, by an intermediate layer to constitute a cleaning pad.

18 Claims, 4 Drawing Figures

PILE CLEANING MATERIAL AND NEEDLING METHOD OF MAKING SAME

FIELD OF THE INVENTION

The invention relates to cleaning articles, and in particular to a fibrous material for cleaning surfaces susceptible to damage by abrasion.

BACKGROUND

Although the invention is not limited to such a use, it will be convenient to discuss the background of the invention in terms of the cleaning of cooking-pans having so-called "non-stick" surfaces, for example, those polytetrafluoroethylene surface layers known under the Trade Mark "TEFLON". Such pans have been in common use for many years, and there have been many attempts to provide a cleaning material that will provide a mechanical cleaning action (when being rubbed across the surface) without abrading the "non-stick" surface.

Non-woven materials have been tried, but in order to give them the desired cleaning effect it has been considered necessary to use, for example, hard fillers or binders, or to fuse some of the fibers together into knobs, which tends, however, to produce a material that is somewhat abrasive and that has a scratchy feel liable to lead the consumer into believing the product may scratch delicate surfaces.

SUMMARY OF THE INVENTION

It is the object of the present invention to provide a cleaning material constituted of a non-woven web of fibers having ends or loops protruding from one face thereof, obtained by needling a web containing a mixture of at least two fibers, one of which has a "weight" of at least 100 decitex, and the other a "weight" equal to or less than 30 decitex.

In the present specification, all reference to the "weight" of a fiber means the "mass per unit length", said weight being measured in decitex (grams per 10,000 meters) and the terms "heavy" and "light" are used with corresponding meanings.

According to one embodiment of the invention, the web comprises two different type of fibers. Preferably, In this case, the lighter fibers have advantageously a weight of between 17 and 30 decitex, and preferably, between 17 and 22 decitex, and advantageously make up 35 to 55%, and preferably, 40 to 50%, of the mass of fibers, and the heavier fibers have advantageously a weight of between 100 and 200 decitex.

According to a preferred variant of the invention, the non-woven web is obtained by needle-punching layers constituted of a mixture of fibers of three different weights; the heaviest fibers are advantageously of 100 to 200 decitex, and preferably about 140 decitex and they form the upstanding ends or loops, namely the ends or loops protruding from one of the faces of the web; said fibers, by virtue of their stiffness, provide a mechanical cleaning action. The fibers of intermediate weight are advantageously between 30 and 90, and preferably about 70 decitex and serve to form a strong and durable although bulky web. The lightest fibers are advantageously between 6.7 and 22, and preferably about 17 decitex and give a homogeneous web owing to their good spreading capacity.

By way of example, a material in which the three fiber sizes are respectively 140, 70 and 17 decitex has been found to be fully satisfactory.

Advantageously, between 40 and 60% and preferably about 50%, of the mass of fibers are of the largest of the three weights, and between 10 and 25% and preferably about 25% of the mass are of the smallest of the three weights.

The web is advantageously between 4 and 6 mm thick including the raised ends and/or loops and advantageously has a total weight of between 300 and 1000 g/m2 and, preferably between 400 and 600 g/m2.

The cleaning material according to the present invention can produce a satisfactory cleaning action without the need for modifying the fibers on the cleaning surface to give an abrasive action (for example, by fusing some of the fibers) or to be coated, admixed, or otherwise treated with a binder or filler or any other material having an abrasive effect.

Nor, in general, will it be necessary to provide any reinforcement for the fibers on the cleaning surface, because the treatment is sufficient to confer the desired strength to the web.

The fibers used for obtaining the material according to the invention may be synthetic or artificial fibers. Synthetic fibers may be composed of any suitable plastic material and, more especially of a polyolefin, such as polypropylene, or a polyamide, such as "Nylon-6" or a polyester, such as the polyterephthalate of ethylene glycol available under the trade name "TERGAL", or a blend of any two or more such materials. Preferably, the fibers consist wholly or partly of polypropylene, which offers advantages in terms of cost, durability and variety of colors available. The plastic material constituting the fibers may be a homo- or co-polymer, for example, a co-polymer of propylene and ethylene. The crystallinity of the polypropylene used may be about 50%.

The fibers preferably consist substantially wholly of polypropylene, polyamide and/or polyester, but if desired there may be a minor proportion (say, up to about 15% by mass) of one or more other materials, for example, artificial fibers such as those obtained from viscose, provided that the overall performance of the cleaning material is not unduly affected. For example, although viscose fibers have desirable properties in terms of absorbency, they have proved to be mechanically rather weak and the presence of too high a proportion of weak fibers will detract from the cleaning efficiency of the material according to the invention and can diminish the characteristics of the web.

An especially important application of the cleaning material according to the invention is the cleaning of "non-stick" kitchen ware of all kinds, but the material also has other uses, for example, in cleaning sanitary ware, and it may even be used for cleaning human skin.

Another characteristic of the cleaning materials according to the invention is that they are themselves easy to rinse and clean.

The said ends or loops may have been raised from the surface of the web by needle-punching or any other suitable means. The surface of the web containing the ends or loops constitutes the cleaning surface.

The web containing a mixture of fibers which is used for producing the cleaning material according to the invention may be advantageously obtained by pneumatic means from a suitable mixture of fibers or by carding and cross-lapping layers constituted of the suitable fiber mixture. In this latter case, the non-woven web then advantageously comprises a plurality of superposed layers held together by the needle-punched fibers of the different layers.

Typically, there may be between 4 and 10 superposed layers although in certain cases their number may reach 20 or 30. In general, the appropriate number of layers will depend on the homogeneity of the fiber dispersion, on the weight of the individual layers, and on the desired final thickness and total weight of the web.

A further object of the invention is to provide a cleaning pad comprising a web of cleaning material according to the invention, in combination with a body of porous water-absorbing material, which may be a foam or sponge material and is preferably a regenerated cellulose sponge, but which may instead be, for example, a polyurethane foam, said body being directly or indirectly bonded to the face of the web opposite the cleaning surface.

The invention also contemplates a method of making a cleaning material according to the invention which consists in needle-punching a web of a suitable mixture of fibers in such a manner as to raise ends and/or loops of fibers from one face thereof. The method according to the invention comprises a first single or twin needle-punching treatment for reinforcing the web, followed by a special needle-punching treatment designed to produce the loops and/or ends on one of the faces of the web. Said special needle-punching treatment is a single needle-punching advantageously using special needles with concave tips or needles known as single-barb needles, which pick up the fibers on one face, drive them through the web and form upstanding loops and/or ends on the opposite face.

The cleaning method according to the invention is particularly suitable for cleaning an article, especially a cooking utensil having a "non-stick" finish. Such cleaning consists in applying a cleaning material according to the invention or the web of cleaning material of a cleaning pad according to the invention, to the article, in such a way as to produce a mechanical cleaning action normally by rubbing.

BRIEF DESCRIPTION OF THE FIGURES OF THE DRAWING

The invention will be more readily understood on reading the following detailed description with reference to the accompanying drawings in which.

DETAILED DESCRIPTION OF PREFERRED EMBODIMENTS

Figure 2:
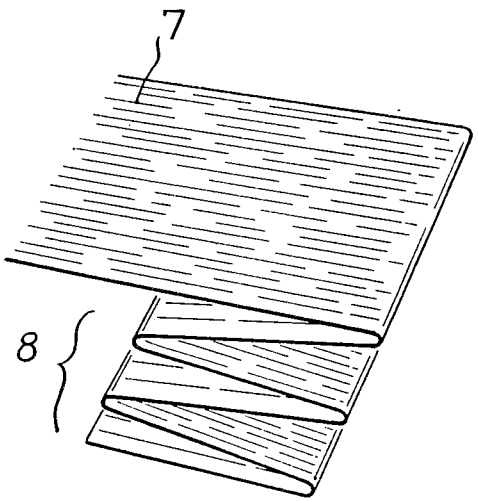
FIG. 2 is a diagrammatic illustration showing the formation of a web from a layer.

According to one particular embodiment of the invention, the web is obtained from a suitable mixture of fibers by a carding/cross-lapping operation. In this case, the fiber mixture is first carded in the card (1) to form a layer (7), which layer is thereafter lapped in a cross-lapping machine (2). The resulting web (8) shown in FIG. 2 is then subjected to a needle-punching to form the ends and/or the loops. Advantageously, the web is first subjected to a preliminary needle-punching in (3) to interconnect the layers; then the web is strengthened by a single or twin needle-punching in (4) before undergoing the special needle-punching (5) for producing the loops and/or the ends. Then the web is preferably rolled in (6) or stored in any other way.

Figure 1:
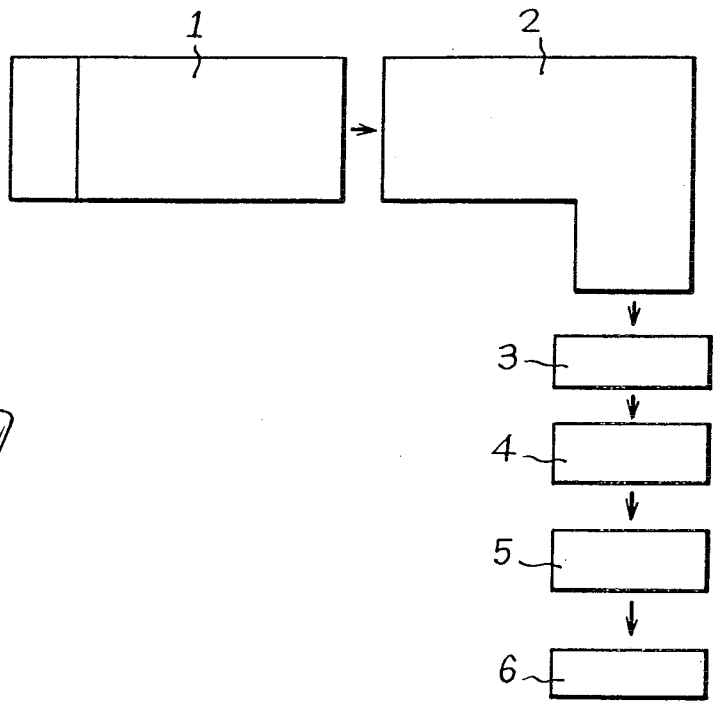
FIG. 1 is a diagrammatic illustration of the operations which can be used for producing the non-woven web according to the invention.

The production diagram of a cleaning material produced from a web obtained by pneumatic means is as illustrated in FIG. 1, the only difference being that the card (1) and the cross-lapping machine (2) are replaced by a suitable pneumatic system (air laying system).

Figure 3:
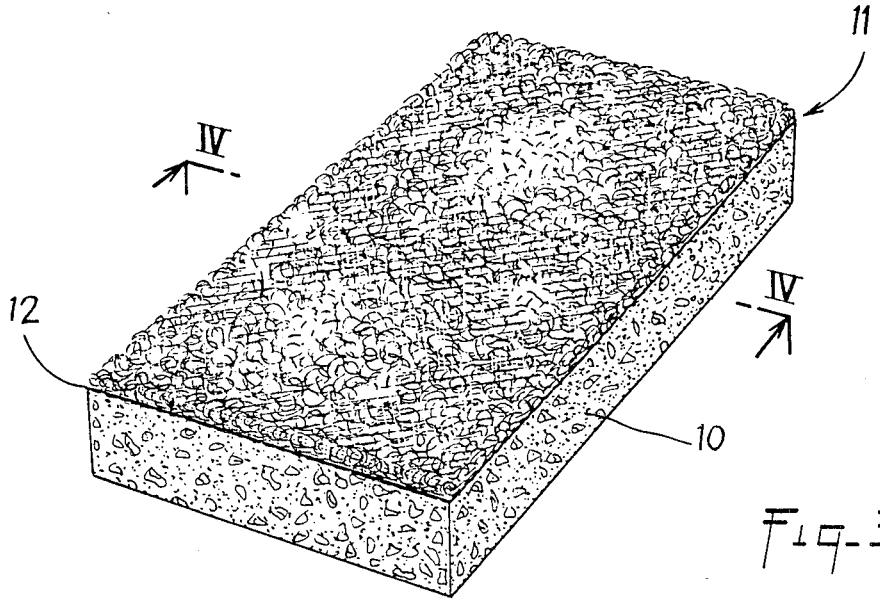
FIG. 3 is a perspective view which illustrates a cleaning pad according to the invention.

The pad, illustrated in FIG. 3, comprises a body of regenerated cellulose sponge material (10) having a web of non-woven fibers (11) according to the invention, bonded to one face with an interlayer (12).

Figure 4:
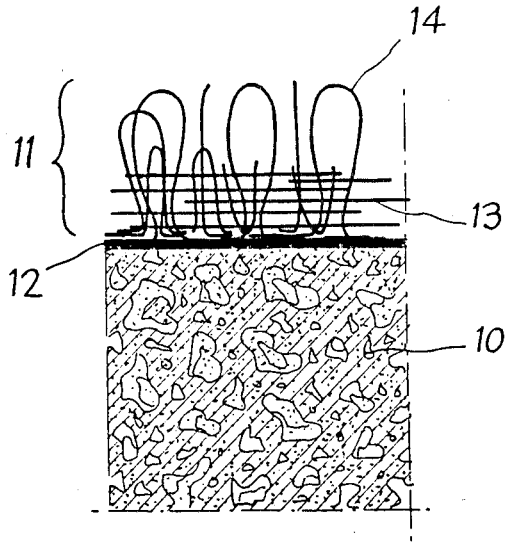
FIG. 4 is a partial cross-section, on enlarged scale, of the pad taken along line IV—IV in FIG. 3.

As illustrated in FIG. 4, the non-woven web of fibers (11) comprises a dense part (13) formed of fibers which are generally parallel to the plane of the web and an outer part (14) of loops and/or free ends of fibers projecting from the web in a mostly perpendicular direction, said outer layer constituting the cleaning face of the non-woven web according to the invention. The non-woven web of fibers (11) is advantageously formed of polypropylene fibers. The interlayer (12) may be formed of any suitable material which may be applied on the rear face of the non-woven web of fibers (11), which will not migrate through said web, which will prevent the migration of the adhesive used for bonding the sponge (10) through the fibrous layer and which, preferably, is permeable to water. Thus, for example, the interlayer (12) may be a latex binder or a thermoplastic film, such as a polyethylene or polypropylene film, which may be fixed to the web within the needle-punching operation. According to a variant, if an adhesive is used that will bond the cellulose sponge directly to the polypropylene fibers, and will not migrate through the fibrous layer, the interlayer (12) may be omitted. It may similarly be omitted where the sponge or foam body (10) consists of a material which can be bonded directly to the non-woven web without the use of an adhesive. For example, a polyurethane or polyethylene foam can be bonded directly by fusion.

In use, the outer layer (14) of the fibrous web (11) may be used to rub over a surface that is to be cleaned, while the sponge (10) serves as a water reservoir both when using the cleaning pad and when rinsing it out.

The following examples are given to illustrate the invention without restriction.

EXAMPLE 1

A non-woven web of fibers of 300 to 1000 g/m2 is obtained, which web is constituted of polypropylene fibers of a length between 40 and 100 mm. Between 40 and 60% of the mass of fibers are constituted of fibers of 100 to 200 decitex, 10 to 25% of the mass are constituted by fibers of between 6.7 and 22 decitex, and the remaining part is constituted by fibers of between 30 and 90 decitex. Preferably, 60% of the mass are constituted of polypropylene fibers of 140 decitex, 20% of the mass being constituted of fibers of 70 decitex and the remaining 20% of fibers of 17 decitex. The resulting web has a weight per m2 of 600 g and a thickness of about 6 mm.

If one of the three weights of fiber is at or towards the upper end of the range given, the others are advantageously at or towards the lower ends of the corresponding range, and vice versa. If the heaviest fibers are at or towards the upper end of their range, or if the lightest fibers are at or towards the lower end of their range, then those fibers are advantageously fewer than the preferred value.

The thickest, heaviest, fibers provide the cleaning action of the fibrous web (11), which relies on the stiffness of the thick fibers standing up to form the outer layer (14). The dense part (13) is mainly constituted of light and intermediate fibers. The intermediate fibers provide bulk, mechanical strength and durability to the web. The light fibers fill in the gaps between the thicker fibers and ensure that the web is uniform both visually and functionally.

EXAMPLE 2

The fibrous web consists of only two different weights of polypropylene fibers, 35 to 55% of the mass of fibers of 17 to 22 decitex and the rest 100 to 200 decitex. The structure of this web is virtually identical to that of Example 1, although its cleaning properties may be less good.

EXAMPLE 3

In this example, the cleaning pad according to the invention comprises a sponge layer (10) about 20 mm thick, and a non-woven layer of fibers (11) between 4 and 6 mm thick, a mass of about 300 to 1000 g/m2 and preferably about 400 to 600 g/m2. The cleaning pad may be about 10 to 15 cm long and about 5 to 10 cm wide.

The body (10) may be formed of a cellulose sponge or any other suitable material in sponge or foam form (such as for example polyurethane or polyethylene foam).

The cleaning material according to the invention may also be produced in glove or mitten form, or it can be incorporated to a glove or mitten, in which case it is combined to a spongy mass or to an impervious layer which constitutes the other part of the glove.

What I claim is:

1. A cleaning material comprising a single non-woven web of fibers having ends and/or loops protruding from one face thereof, said protruding fibers being obtained by needle-punching, said web containing a mixture of at least two fibers, one of which has a weight of at least 100 decitex, and the other a weight equal to or less than 30 decitex.

2. A material as claimed in claim 1, wherein the lighter fibers have a weight between 17 and 30 decitex and make up 35 to 55% of the mass of fibers, and the heavier fibers have a weight between 100 and 200 decitex.

3. A material as claimed in claim 2, wherein the lighter fibers have a weight between 6.7 and 22 decitex.

4. A material as claimed in claim 1, wherein said fibers of said non-woven web is made up of three different weights, one of the weights being at least 100 decitex, the other being equal to or less then 30 decitex and the third being an intermediate weight.

5. A material as claimed in claim 4, wherein the intermediate weight is between 30 and 90 decitex.

6. A material as claimed in claim 4, wherein the heavier fibers have a weight between 100 and 200 decitex.

7. A material as claimed in claim 4, wherein the web is obtained from a mixture of three fibers having weights of 17, 70 and 140 decitex respectively.

8. A material as claimed in claim 7, wherein the mixture of fibers contains 40 to 60% heavy fibers and 10 to 25% light fibers.

9. A material as claimed in claim 8, wherein the mixture of fibers contains about 60% heavy fibers, about 20% light fibers and about 20% intermediate fibers.

10. A material as claimed in claim 1, wherein the weight of the web is between 300 and 1000 g/m$^2$.

11. A material as claimed in claim 10, wherein the weight of the web is between 400 and 600 g/m$^2$.

12. A material as claimed in claim 10 wherein the weight of the web is 600 g/m$^2$.

13. A material as claimed in claim 1, wherein the fibers are essentially constituted of polyamide, polyester or polypropylene or a mixture thereof.

14. A material as claimed in claim 13, wherein the fibers are essentially constituted of polypropylene.

15. A cleaning pad, wherein said pad comprises a body made of a porous substance bonded directly or indirectly to the cleaning material as claimed in claim 1, at the face thereof opposite the cleaning surface.

16. A cleaning pad as claimed in claim 15, wherein the porous body is a foam or a sponge.

17. Method of making a cleaning material as claimed in claim 1, wherein said method consists in needle-punching said single web made from a mixture of fibers, in order to form on one of its faces, said ends and/or loops protruding from said face.

18. Method as claimed in claim 17, wherein the web is obtained by pneumatic means or by carding/cross-lapping a mixture of at least two fibers, one of which has a weight of at least 100 decitex and the other a weight equal to or less than 30 decitex.

* * * * *